US005917396A

United States Patent [19]

Halser, III

[11] Patent Number: 5,917,396

[45] Date of Patent: Jun. 29, 1999

[54] WIDEBAND AUDIO OUTPUT TRANSFORMER WITH HIGH FREQUENCY BALANCED WINDING

[76] Inventor: Joseph G. Halser, III, 5905 S. Howell Ave., Milwaukee, Wis. 53207

[21] Appl. No.: 08/905,875

[22] Filed: Aug. 4, 1997

[51] Int. Cl.[6] ..... H01F 27/28; H01F 27/30

[52] U.S. Cl. ..... 336/180; 336/183; 336/186; 336/205

[58] Field of Search ..... 336/180, 183, 336/186, 205

[56] References Cited

U.S. PATENT DOCUMENTS

| | | | |
|---|---|---|---|
| 1,815,620 | 7/1931 | Horn | 336/206 |
| 2,477,074 | 7/1949 | McIntosh | 179/171 |
| 2,680,218 | 6/1954 | Keroes | 317/220 |
| 2,791,646 | 5/1957 | Keroes | 179/171 |
| 3,061,804 | 10/1962 | Bereskin | 336/84 |
| 3,102,245 | 8/1963 | Lawson, Jr. | 336/84 |
| 3,168,715 | 2/1965 | Woodworth | 333/11 |
| 3,573,648 | 4/1971 | Nestorovic | 330/82 |
| 3,895,335 | 7/1975 | Manimalethu | 336/183 |
| 3,939,449 | 2/1976 | Boyd et al. | 336/206 |
| 4,311,977 | 1/1982 | Owen | 336/69 |
| 4,490,844 | 12/1984 | Sohn | 381/104 |
| 4,631,511 | 12/1986 | Sylvester, Jr. et al. | 336/180 |
| 4,755,783 | 7/1988 | Fleischer et al. | 336/84 |
| 4,847,984 | 7/1989 | Rossi et al. | 336/200 |
| 5,124,681 | 6/1992 | Chen | 336/206 |
| 5,422,599 | 6/1995 | Larsen | 330/196 |
| 5,500,632 | 3/1996 | Halser, III | 336/180 |

FOREIGN PATENT DOCUMENTS 24 45 143 4/1976 Germany .

25 41 871 3/1977 Germany .

OTHER PUBLICATIONS

Is the Output Transformer Out? by Herbert Ravenswood.

*Primary Examiner*—Renee S. Luebke
*Assistant Examiner*—Anh Mai
*Attorney, Agent, or Firm*—Andrus, Sceales, Starke & Sawall

[57] ABSTRACT

A wideband audio output transformer for use with a push-pull vacuum tube amplifier using a multifilar ribbon in which primary windings and secondary windings coexist. The multifilar ribbon is wound continuously around a common core side by side to form successive layers. The primary windings are connected in series by turning the multifilar ribbon after the layers of multifilar ribbon have been wound and connecting the trailing end of the multifilar ribbon to the beginning end of the multifilar ribbon. Two additional wires are added in parallel with wires of the primary windings in the multifilar ribbon to redistribute the effective capacitance throughout the windings. The winding scheme eliminates the signal imbalance of an output transformer with a balanced push-pull primary winding and an unbalanced secondary winding at high frequencies. The winding scheme also increases the coupling between the first half primary, the second half primary and the secondary windings without compromising transformer performance at high frequencies. The secondary windings are connected in parallel to obtain the proper turns ratio for the transformer. The center tap of the balanced push-pull primary winding and one side of the unbalanced secondary winding is connected to AC ground.

1 Claim, 5 Drawing Sheets

WIDEBAND AUDIO OUTPUT TRANSFORMER WITH HIGH FREQUENCY BALANCED WINDING

FIELD OF THE INVENTION

The present invention relates to transformers, and in particular, to wideband audio output transformers with a balanced push-pull primary winding, an unbalanced secondary winding, and additional wires added in parallel with wires of the primary winding to reduce signal imbalance at high frequencies.

BACKGROUND OF THE INVENTION

The present invention is an improvement of my earlier patent U.S. Pat. No. 5,500,632, issued to the inventor Joseph G. Halser, III on Mar. 19, 1996 entitled "Wide Band Audio Transformer With Multifilar Winding", which is incorporated herein by reference. The purpose of this improvement is to reduce signal imbalance at high frequencies in wideband audio output transformers having a balanced primary winding and an unbalanced secondary winding.

Audio systems with vacuum tube amplifiers are still commercially available and gaining interest even though most modem audio systems typically use solid state transistors. Nonetheless, many people still prefer vacuum tube amplifiers because they enjoy the sound produced by the vacuum tube amplifiers, because they enjoy the lights of the vacuum tubes, or for other reasons. One type of popular vacuum tube amplifier circuit configuration is the push-pull amplifier circuit.

In a push-pull amplifier circuit, one output vacuum tube amplifies the positive half of an input signal, while another output vacuum tube amplifies the negative half of the input signal. Both halves of the signal are input in the primary winding and ultimately combined in the secondary winding of an output transformer. The output vacuum tubes of the push-pull amplifier circuit drive the primary winding of the output transformer, while the secondary winding provides power to the speaker load typically at high currents and low voltages. A conventional push-pull output transformer comprises three windings wound around a magnetic core; a half primary winding for each half of the input signal, and a secondary winding for the speaker load. The vacuum tube push-pull amplifier circuit requires a wideband iron core output transformer to match the high impedance vacuum tubes of the amplifier to the much lower impedance speaker load. The output transformer is the most limiting and most expensive component of an audio amplifier. The output transformer limits bandwidth, efficiency and causes phase shifts at high and low frequencies which may result in instability of an amplifier utilizing negative feedback.

Most audio output transformers utilize a balanced push-pull primary winding and an unbalanced (i.e., single-ended) secondary winding which matches the high impedance output of a push-pull amplifier circuit to the low impedance of the ground referenced speaker load. Typically in this configuration, the center tap of the primary winding and one end of the secondary winding is connected to AC ground. An important advantage of the single-ended secondary winding is that less taps need to be brought out for different speaker loads. The taps have equal high frequency performance, and utilize all the wire in the secondary winding.

At high frequencies, the AC potential difference between each half primary winding and the secondary winding is unequal causing the effective capacitance between each half primary winding and the secondary winding to be different.

This results in a signal imbalance at high frequencies (i.e., the amplitudes of the signals in the two half primary windings are different at high frequencies causing distortions in the secondary winding signal). In contrast, a circuit under balanced conditions has sinusoidal signals with identical amplitudes and shifted in time with respect to each other by identical phase angles.

One way of eliminating the signal imbalance at high frequencies is to provide an output transformer with a balanced primary winding and a balanced secondary winding (i.e., two branches that are electrically alike and symmetrical with respect to a common reference point). However, this eliminates the advantages of using an unbalanced (i.e., single-ended) secondary winding, and ground referenced equipment can no longer be used with the amplifier. A balanced secondary winding also requires two feedback paths, one from the high side of the secondary winding and one from the low side of the secondary winding back to the input. An unbalanced secondary winding only requires one feedback path from the output back to the input because one end of the output is connected to AC ground.

Another way to eliminate the signal imbalance is to provide an amplifier without an output transformer. However, this greatly complicates the amplifier design, and severely compromises performance of the audio system.

Signal imbalance may also be eliminated by adding more insulating material between the primary and secondary windings in an effort to reduce the effective capacitance. This requires substantially more insulating material on the half primary winding with the greatest effective capacitance. Increasing insulating material on only one half primary winding complicates the manufacturing process because the transformer would have different thicknesses of insulating material in different places on the transformer windings. The increase in insulating material also causes wires to be further apart, thus reducing coupling and increasing leakage inductance. It is important to keep the leakage inductance and effective capacitance at a minimum.

Leakage inductance is the result of imperfect magnetic coupling between the primary and secondary windings. The leakage inductance may be reduced by increasing the winding width, minimizing the spacing between windings, or subdividing the primary winding into sections and placing the secondary winding between the subdivided primary windings, as in bifilar or multifilar windings.

Effective capacitance may be reduced by increasing the insulating material or dielectric thickness between windings, reducing the winding width, increasing the number of layers, or avoiding large potential differences between winding sections.

Packaging primary and secondary windings in a multifilar ribbon are known in the art to reduce leakage inductance and effective capacitance as detailed in my earlier patent, U.S. Pat. No. 5,500,632, entitled "Wideband Audio Transformer With Multifilar Winding." In this transformer, high AC voltage potential may exist between adjacent wires of the multifilar ribbon, and the wires must be adequately insulated to withstand these high AC voltage potentials. Also, multifilar ribbon windings may create considerable capacitance between adjacent wires limiting the high frequency performance of the amplifier.

In a transformer with multifilar ribbon windings, each wire has a capacitance with respect to the two wires on each side of it in the same layer, and also with respect to wires in the layers above and below it. While capacitance between the wires in adjacent layers may be reduced by increasing the spacing between layers, this increases the leakage inductance of the transformer as mentioned above.

In order to improve the performance of the output transformer at high frequencies, it is desirable to provide a practical and easy winding scheme that reduces signal imbalance at high frequencies without greatly increasing leakage inductance or effective capacitance.

SUMMARY OF THE INVENTION

The present invention is a wideband audio output transformer with a balanced primary winding, an unbalanced secondary winding, and two additional wires added in parallel with wires of the primary winding. Using the additional wires in parallel with wires of the primary winding is a practical way to reduce the signal imbalance in the primary winding at high frequencies without otherwise compromising the transformer performance.

The multifilar ribbon consists of several adjacent wires, each wire preferably being made of the same size or gauge. The two additional wires coexist in a multifilar ribbon with the wires of the primary and secondary windings. The two additional wires are located at opposite sides of the multifilar ribbon between the outside of each half primary winding and inside the outer wires of the secondary winding. The multifilar ribbon is wound side by side through successive layers and then re-enters the transformer structure at the beginning in order to connect each of the primary windings of the multifilar ribbon in series. The secondary windings are connected in parallel. The number of series connected primary windings compared to the parallel connected secondary windings is the turns ratio for the transformer.

Each multifilar ribbon contains the wires for both half primary windings, the wires for the secondary winding and the two additional wires added in parallel with wires of the primary winding. The primary winding is separated into two groups of wires, each group representing a half primary winding for a push-pull amplifier circuit. The wires of each half primary group are connected in series re-entry as each wire is wound around the transformer core. The secondary winding is also separated into two groups of secondary wires. The wires of the secondary groups are connected in parallel.

Each half primary group of wires is sandwiched between the two secondary groups of wires in the multifilar ribbon to maintain good coupling, reduce leakage inductance and reduce effective capacitance between points of greatest AC potential. The wires of the first secondary group are located in the middle of the multifilar ribbon. Located on each side of the first secondary group of wires are the two half primary groups of wires. On the outside of the two half primary groups of wires is the second secondary group of wires. The second secondary group of wires is divided equally in half, with one half of the second secondary group of wires located on the outside of the first half primary group of wires, and the other half of the second secondary group of wires located on the outside of the second half primary group of wires. The two additional wires are located on the outside of each half primary group of wires and inside the two halves of the second secondary group of wires.

Since the effective capacitance of one half primary winding to the secondary winding is different from the effective capacitance of the second half primary winding to the secondary winding, a substantial signal imbalance in the primary winding would exist at high frequencies about the invention. The amplitudes of the signals in the two half primary windings are different at high frequencies causing distortions in the secondary winding signal. In accordance with the invention, this problem is solved by adding two additional wires in parallel with wires of the primary winding to redistribute the capacitance and eliminate the signal imbalance at high frequencies. One additional wire is added in parallel with a wire of each half primary winding in the multifilar ribbon. The two additional wires equalize the potential difference and effective capacitance between each half primary winding and the secondary winding.

It is preferred that the primary wires in the multifilar ribbon be in an order that equalizes the AC potential difference between the first half primary winding and the secondary winding, and between the second half primary winding and the secondary winding. Using the additional wires in parallel with wires of the primary windings is a practical and easy way to reduce the signal imbalance in the primary winding at high frequencies without otherwise compromising transformer performance. Such a winding pattern also facilitates transformer fabrication because only two extra wires are added to the multifilar ribbon.

The invention results in tight coupling between the windings because the primary and secondary wires are wound side by side in the multifilar ribbon. This is in contrast to conventional transformers where coupling is typically increased by sandwiching alternating layers of primary wires and secondary wires.

In addition, the invention reduces effective capacitance without significantly increasing leakage inductance. Effective capacitance is controlled by redistributing the AC potentials among the primary wires. Also, capacitance associated with the multifilar ribbon is in series, which tends to reduce capacitance. The use of interlayer insulation does not significantly effect leakage inductance because coupling is provided by the multifilar ribbon.

To those skilled in the art, it should be apparent that the present invention reduces the signal imbalance in the primary winding at high frequencies by adding two additional wires in parallel with the primary wires to equalize the effective capacitance in the two half primary windings. This creates an equal AC potential difference and an equal effective capacitance between the first half primary winding group of wires and the second half primary winding group of wires.

Various other features, objects and advantages of the invention will be made apparent from the following drawings and detailed description.

DETAILED DESCRIPTION OF THE INVENTION

Figure 1:
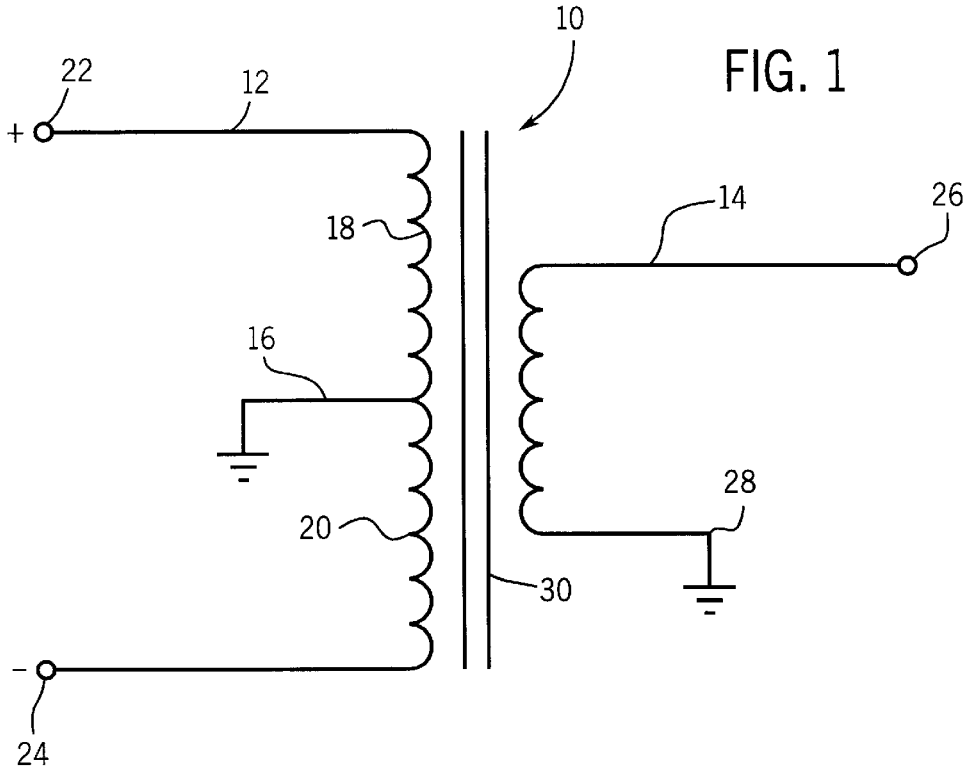
FIG. 1 is a schematic representation of a wideband audio output transformer with a balanced primary winding and an unbalanced secondary winding.

FIG. 1 is a schematic representation of a wideband audio output transformer 10 with a balanced push-pull primary winding 12 and an unbalanced secondary winding 14. The balanced primary winding 12 includes a center tap 16 that is connected to AC ground and separates the balanced primary winding 12 into a first half primary winding 18 and a second half primary winding 20. A push-pull amplifier circuit (not shown) is connected to the balanced push-pull primary winding 12 at a positive input 22 and a negative input 24. In a push-pull amplifier circuit, one output vacuum tube amplifies the positive half of an input signal 22 during one half of the cycle, while another output vacuum tube amplifies the negative half of the input signal 24 during the other half of the cycle. Both halves of the signal are combined in the secondary winding 14. The secondary winding 14 is connected to a speaker load at output terminal 26. The other end of the secondary winding 14 is connected to AC ground at ground reference point 28. This ground reference point 28 may be connected to a ground reference point of the speaker load (not shown). Therefore, a push-pull output transformer 10 comprises three windings around a magnetic core 30; a positive half primary winding 18, a negative half primary winding 20, and a secondary winding 14. The balanced primary winding 12 follows both the positive and negative amplitudes of the push-pull amplifier signal. The unbalanced secondary winding 14 combines the push-pull amplifier signals and provides a positive amplitude output signal to the speaker load at output terminal 26.

Figure 2:
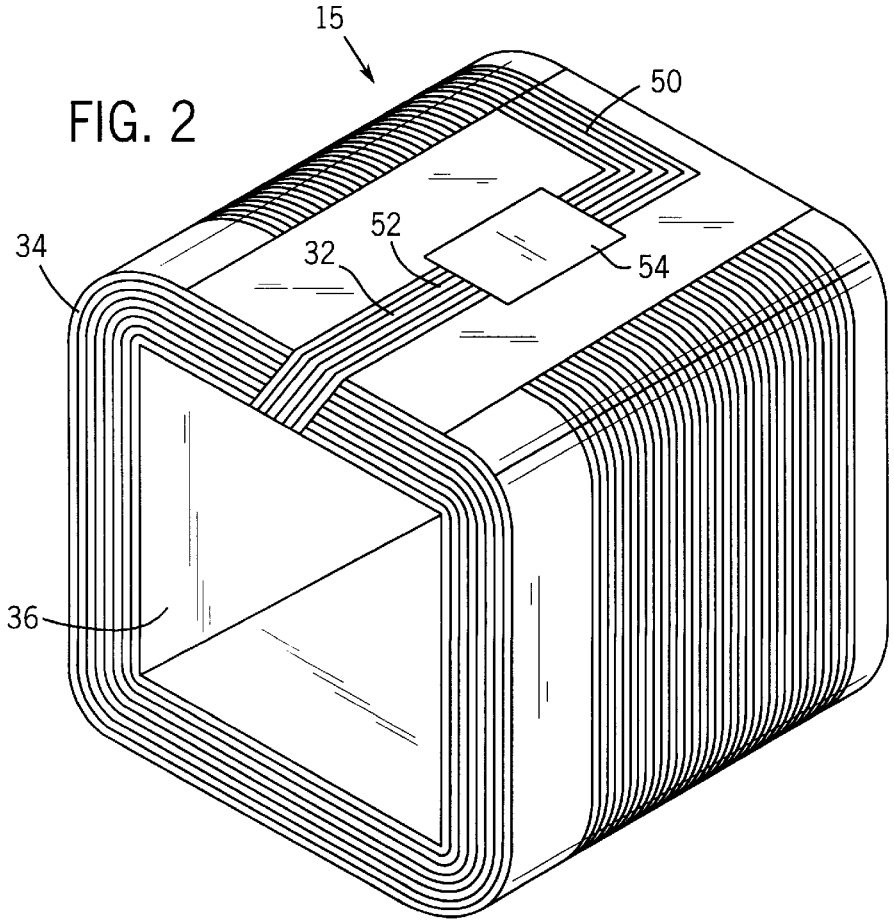
FIG. 2 is perspective view of a wideband multifilar audio output transformer wound in accordance with the invention with the primary wires connected in series re-entry and the secondary wires connected in parallel.

Referring to FIG. 2, a coil structure 15 is made by winding a multifilar ribbon 32 side by side and in successive layers 34 around a bobbin 36. The multifilar ribbon 32 contains parallel wires having the same diameter which will constitute the primary 12 and secondary 14 windings of the coil structure 15. The multifilar ribbon 32 is wound around the bobbin 36 to form the coil structure 15 of the transformer 10.

Figure 3:
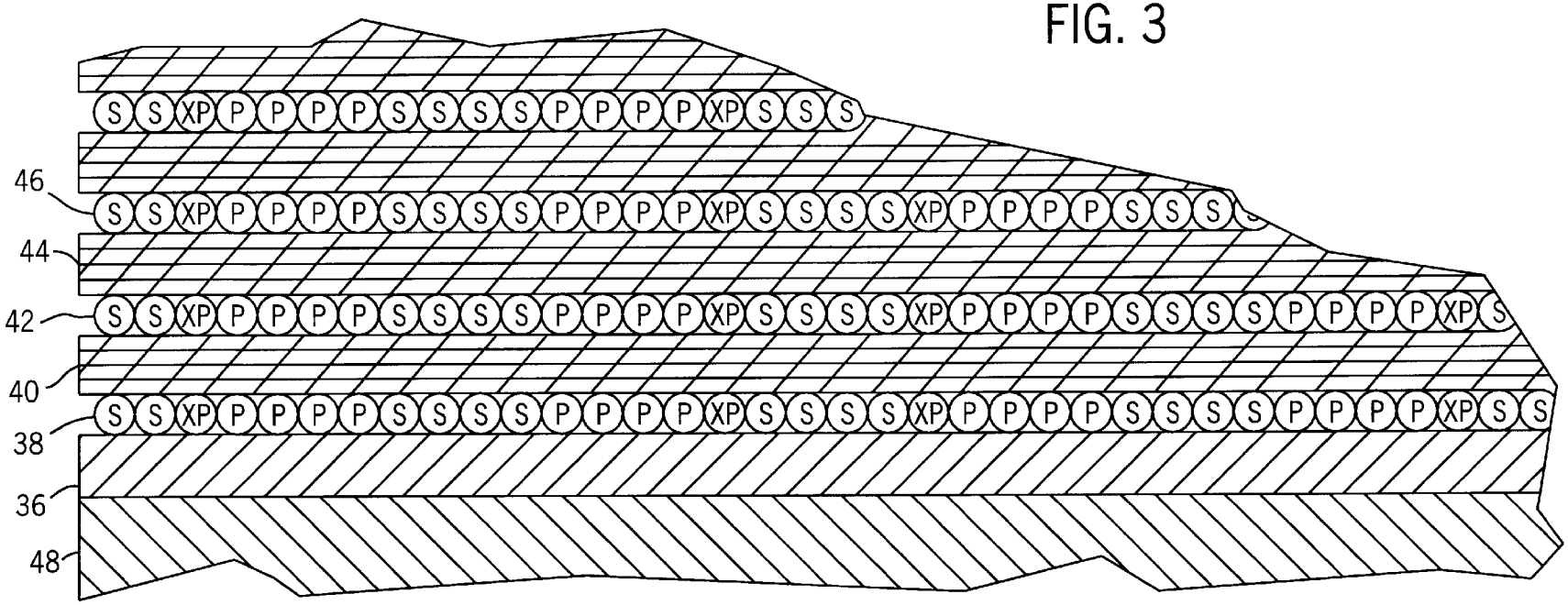
FIG. 3 is a partial cross sectional view taken through the layers of the transformer shown in FIG. 2.

As shown in FIG. 3, multifilar ribbon 32, FIG. 2, is wound around the bobbin 36 side by side to form a first layer 38 of primary, secondary and additional wires. The primary, secondary and additional wires are labeled P, S and XP, respectively, in FIG. 3. The additional wires are added in parallel with the primary wires to reduce signal imbalance in the primary windings at high frequencies. A layer of rag paper 40 is laid on top of the first layer 38 of wires. A second layer 42 of primary, secondary and additional wires is formed by winding the multifilar ribbon 32 side by side around the layer of rag paper 40. The rag paper 40 is an interleaving material separating the first 38 and second 42 layers of wires. The layer of rag paper 40 not only separates the wires in the second layer 42 from the first layer 38 but also keeps the layers of wires aligned. Another layer of rag paper 44 is laid on top of the second layer 42 of wires, and the multifilar ribbon 32 is wound over the layer 44 of rag paper to form a third layer of wires 46. Successive layers of wires and interleaved layers of rag paper are wound around the bobbin 36 to obtain a transformer 10 with the desired turns ratio. The coil structure 15 also includes a magnetic core 48 upon which the primary, secondary and additional wires are wound. It is preferred that the magnetic core 48 have a large cross sectional area.

Referring again to FIG. 2, when the outermost layer of windings has been wound, the trailing end 52 of the multifilar ribbon 32 is connected to the beginning end 50 of the multifilar ribbon 32. The beginning end 50 of the multifilar ribbon 32 is turned over so that the wires in the multifilar ribbon 32 are cross connected. Cross connection of the trailing end 52 and the beginning end 50 of the primary wires can be accomplished by making connections at connection 54 as depicted in FIG. 2.

Figure 4:
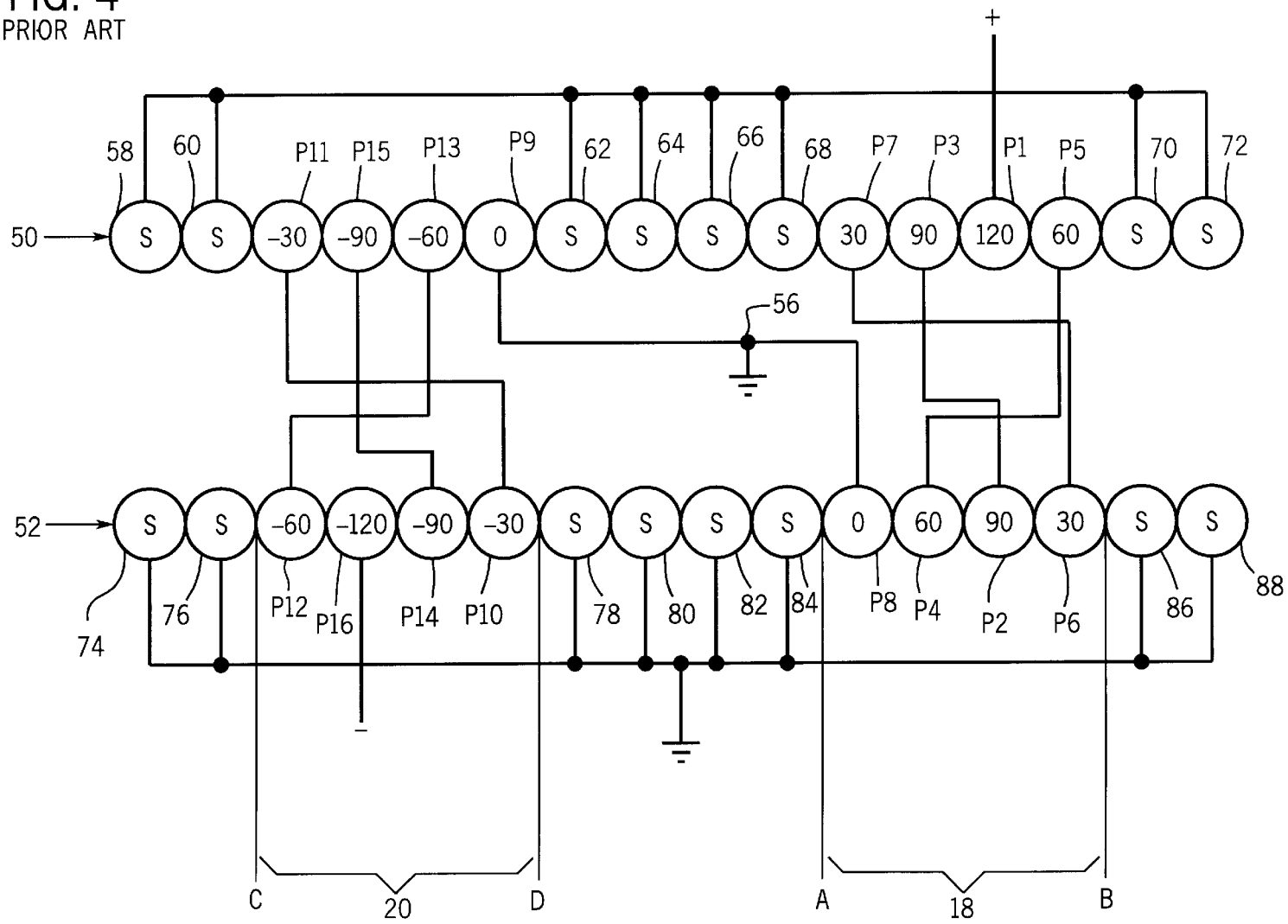
FIG. 4 PRIOR ART
FIG. 4 is a schematic view showing the configuration of primary and secondary wires in a transformer having a turns ratio of 8:1 in accordance with U.S. Pat. No. 5,500,632.

FIG. 4 shows the cross connection of the beginning end 50 of the multifilar ribbon 32 with the trailing end 52 of the multifilar ribbon 32 for a transformer 10 having a turns ratio of 8:1 built in accordance with U.S. Pat. No. 5,500,632. The wires at the beginning end 50 of the multifilar ribbon 32 are represented by the top row. The wires at the trailing end 52 of the multifilar ribbon 32 are represented by the bottom row. There are eight primary wires and eight secondary wires in each row. The secondary wires are labeled with an S. The primary wires are labeled with numbers representing a voltage potential across each wire so that the principle of the invention may be more readily understood.

The primary wire voltage numbers relate to voltages across the primary wires when the transformer is delivering 100 watts of power. There is approximately 240 volts rms across the primary winding input terminals 22 and 24, FIG. 1, or 120 volts rms across each half primary winding 18 and 20. The applied voltages in each half primary winding 18 and 20 are 180° out of phase, so the first half primary winding 18 is assigned positive voltages and is in phase with the secondary winding 14, while the second half primary winding 20 is assigned negative voltages. The 240 volts rms across the primary winding results in 30 volts rms being established across each primary wire as it is wound through the transformer having a turns ratio of 8:1.

The primary wires are positioned in the multifilar ribbon 32 so that the wire of highest voltage potential in each half primary winding is at the center in each primary group of wires and that each adjacent primary wire is at a successively lower voltage potential. In this configuration, the lowest potential primary wires are adjacent to the secondary wires. The multifilar ribbon 32 contains two groups of primary wires, each representing a half primary winding for a push-pull amplifier circuit, and two groups of secondary wires. The two groups of primary wires are sandwiched between and separated by the two groups of secondary wires in the multifilar ribbon 32.

The primary windings are connected in series starting with the first half primary group of wires 18 and then connecting in series to the second half primary group of wires 20. A positive 120 volt rms primary wire P1 is wound around a magnetic core (not shown) becoming a 90 volt rms wire P2. The 90 volts rms wire P2 is connected in series to a 90 volt rms wire P3. The 90 volt rms wire P3 is wound around the core becoming a 60 volt rms wire P4. The 60 volt rms wire P4 is connected in series to a 60 volt rms wire P5. The 60 volt rms wire P5 is wound around the core becoming a 30 volt rms wire P6. The 30 volt rms wire P6 is connected in series to a 30 volt rms wire P7. The 30 volt rms wire P7 is wound around the core becoming a 0 volt rms wire P8 which is the center tap 56 and connected to AC ground. The 0 volt rms wire P8 is connected in series to a 0 volt rms wire P9. The 0 volt rms wire P9 is wound around the core becoming a negative 30 volt rms wire P10. The negative 30 volt rms wire P10 is connected in series to a negative 30 volt rms wire P11. The negative 30 volt rms wire P11 is wound around the core becoming a negative 60 volt rms wire P12. The negative 60 volt rms wire P12 is connected in series to a negative 60 volt rms wire P13. The negative 60 volt rms wire P13 is wound around the core becoming a negative 90 volt rms wire P14. The negative 90 volt rms wire P14 is connected in series to a negative 90 volt rms wire P15. The negative 90 volt rms wire P15 is wound around the core becoming a negative 120 volt rms wire P16. The first half primary winding 18 is represented between points A and B in FIG. 4, and the second half primary winding 20 is represented between points C and D in FIG. 4.

It is preferred that the two groups of secondary wires be wound adjacent to the two groups of primary wires to increase coupling between the windings. Having the primary and secondary wires wound side by side in the multifilar ribbon 32, results in tight coupling between the primary windings and the secondary windings. The secondary wires at the beginning end 50 of the multifilar ribbon 32 are connected in parallel. A first secondary wire in the beginning end 50 of the multifilar ribbon 32 is 58, a second secondary wire is 60, a third secondary wire is 62, a fourth secondary wire is 64, a fifth secondary wire is 66, a sixth secondary wire is 68, a seventh secondary wire is 70, and an eighth secondary wire is 72.

The first group of secondary wires 62, 64, 66, 68 at the beginning end 50 of the multifilar ribbon 32 is located in the middle of the multifilar ribbon 32. Located on each side of the first secondary group of wires 62, 64, 66, 68 are the two half primary groups of wires P7, P3, P1, P5 and P9, P13, P15, P11. Secondary wire 68 of the first group of secondary wires is adjacent to primary wire P7 of the first half primary group of wires 18. Secondary wire 62 of the first group of secondary wires is adjacent to primary wire P9 of the second half primary group of wires 20.

The second group of secondary wires 58, 60, 70, 72 at the beginning end 50 of the multifilar ribbon 32 is split in FIG. 4, with one half of the second secondary group of wires 70, 72 located on the outside of the first half primary group of wires P7, P3, P1, P5, and the other half of the second secondary group of wires 58, 60 located on the outside of the second half primary group of wires P9, P13, P15, P11. Secondary wire 70 of the first half of the second group of secondary wires is adjacent to primary wire P5 of the first half primary group of wires 18. Secondary wire 60 of the second half of the second group of secondary wires is adjacent to primary wire P11 of the second half primary group of wires 20.

The secondary wires at the trailing end 52 of the multifilar ribbon 32 are connected in parallel across the bottom row as shown in FIG. 4. A first secondary wire 74 is connected in parallel with a second secondary wire 76, a third secondary wire 78, a fourth secondary wire 80, a fifth secondary wire 82, a sixth secondary wire 84, a seventh secondary wire 86 and an eighth secondary wire 88.

The first group of secondary wires 78, 80, 82, 84 at the trailing end 52 of the multifilar ribbon 32 is located in the middle of the multifilar ribbon 32. Located on each side of the first secondary group of wires 78, 80, 82, 84 are the two half primary groups of wires P8, P4, P2, P6 and P10, P14, P16, P12. Secondary wire 84 of the first group of secondary wires is adjacent to primary wire P8 of the first half primary group of wires 18. Secondary wire 78 of the first group of secondary wires is adjacent to primary wire P10 of the second half primary group of wires 20.

The second group of secondary wires 74, 76, 86, 88 at the trailing end 52 of the multifilar ribbon 32 is divided equally in half, with one half of the second secondary group of wires 86, 88 located on the outside of the first half primary group of wires P8, P4, P2, P6, and the other half of the second secondary group of wires 74, 76 located on the outside of the second half primary group of wires P10, P14, P16, P12. Secondary wire 86 of the first half of the second group of secondary wires is adjacent to primary wire P6 of the first half primary group of wires 18. Secondary wire 76 of the second half of the second group of secondary wires is adjacent to primary wire P12 of the second half primary group of wires 20.

The number of series connected primary windings to parallel connected secondary windings is the turns ratio for the transformer. The center tap 56 of the primary winding and the secondary wires at the trailing end 52 of the multifilar ribbon 32 are connected to AC ground. The parallel secondary wires at the beginning end 50 of the multifilar ribbon 32 develop to a voltage of 30 volts rms.

There is a 0 volt potential difference between primary wire P7 and secondary wire 68 and between primary wire P8 and secondary wire 84 (point A), and a 30 volt potential difference between primary wire P5 and secondary wire 70 and between primary wire P6 and secondary wire 86 (point B) for the first half primary winding AB. There is a 60 volt potential difference between primary wire P11 and secondary wire 60 and between primary wire P12 and secondary wire 76 (point C), and a 30 volt potential difference between primary wire P9 and secondary wire 62 and between primary wire P10 and secondary wire 78 (point D) for the second half primary winding CD. Thus, the potential difference between each half primary winding 18, 20 and the secondary winding is unequal causing the effective capacitance between each half primary winding 18, 20 and the secondary winding to be unequal. This in turn causes a signal imbalance at high frequencies in the primary winding.

In other words, there is more effective capacitance in the second half primary winding 20 than the first half primary winding 18. The second half primary winding 20 has a 60 volt potential difference between primary wires P11, P12 and secondary wires 60, 76 at point C, and a 30 volt potential difference between primary wires P9, P10 and secondary wires 62, 78 at point D. The first half primary winding 18 has a 0 volt potential difference between primary wires P7, P8 and secondary wires 68, 84 at point A, and a 30 volt potential difference between primary wires P5, P6 and secondary wires 70, 86 at point B. The larger potential difference in the second half primary winding 20 results in a larger effective capacitance in the second half primary winding 20 than the first half primary winding 18 causing a signal imbalance at high frequencies.

Figure 5:
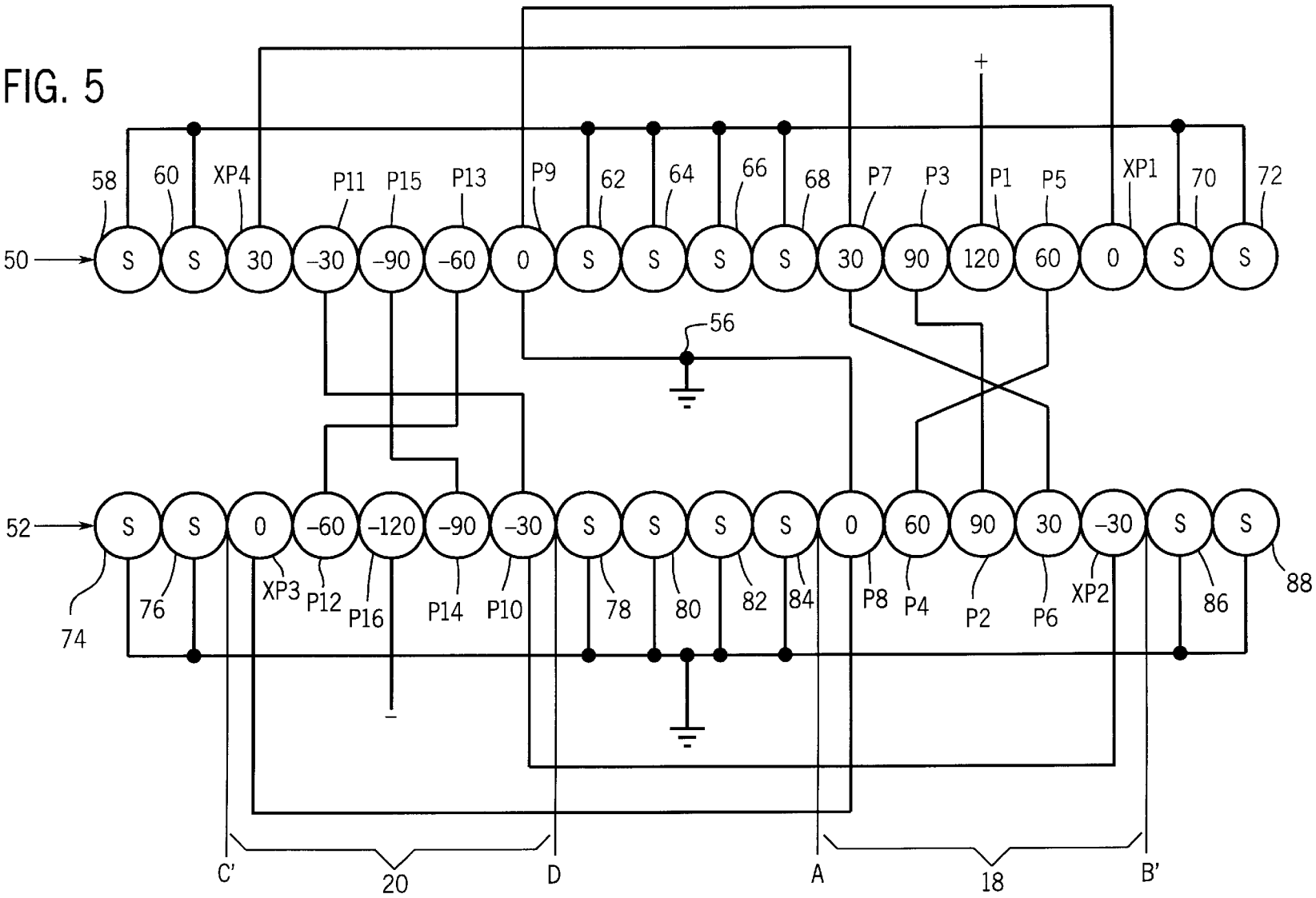
FIG. 5 is a schematic view showing the configuration of primary and secondary wires in a transformer having a turns ratio of 8:1 including two additional wires added in parallel with the primary wires in accordance with the present invention.
Figure 6:
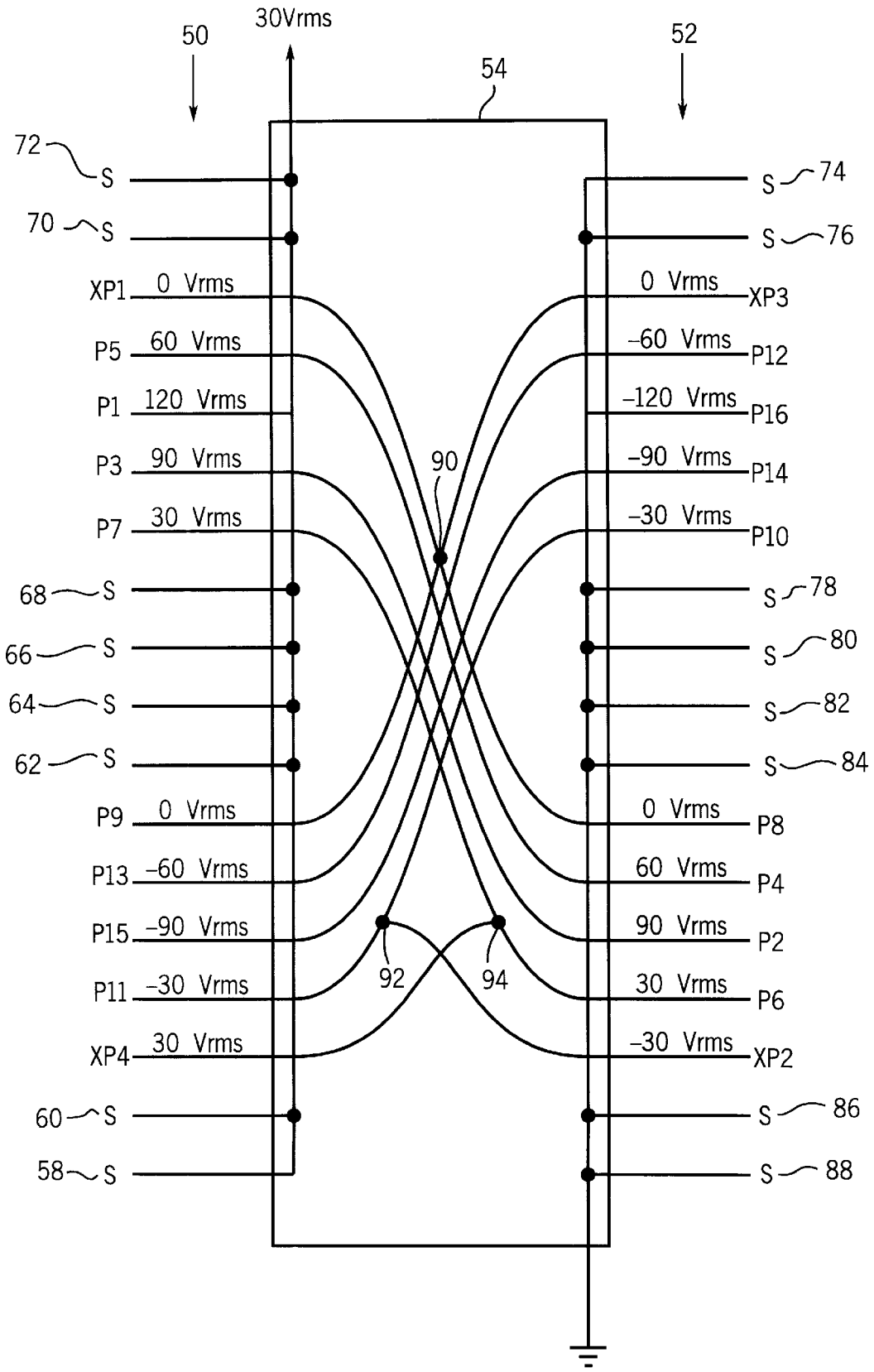
FIG. 6 is a wiring diagram showing the electrical connections between the primary and secondary wires of the transformer illustrated in FIG. 5.

In accordance with the invention, FIGS. 5 and 6 show a transformer that reduces signal imbalance at high frequencies. Two additional wires are added in parallel with the primary windings. These additional wires are labeled XP1 and XP4 at the beginning end 50 of multifilar ribbon 32, and XP2 and XP3 at the trailing end 52 of multifilar ribbon 32. The additional wires equalize the potential difference between each half primary winding 18, 20 and the secondary winding.

Referring in particular to FIG. 5, the multifilar ribbon 32, FIG. 2, contains 18 wires, two more wires than the multifilar ribbon of FIG. 4. The wires at the beginning end 50 of the multifilar ribbon 32 are represented by the top row. The wires at the trailing end 52 of the multifilar ribbon 32 are represented by the bottom row. There are eight primary wires, eight secondary wires and two additional wires in each row. The secondary wires are labeled with an S. The primary wires are labeled with numbers representing a voltage potential across each wire. The two additional wires are labeled XP1 and XP4 at the beginning end of the multifilar ribbon, and XP2 and XP3 at the trailing end of the multifilar ribbon as stated above.

To facilitate understanding of the invention, the primary wire voltage numbers in FIG. 5 again relate to voltages across the primary wires when the transformer is delivering 100 watts of power. In addition, reference characters and the primary wire voltage numbers are the same as those in FIG. 4 where appropriate.

Like the transformer in FIG. 4, the primary windings are connected in series starting with the first half primary group of wires 18 and then connecting in series to the second half primary group of wires 20. As in FIG. 4, a positive 120 volt rms primary wire P1 is wound around a magnetic core (not shown) becoming a 90 volt rms wire P2. The 90 volt rms wire P2 is connected in series to a 90 volt rms wire P3. The 90 volt rms wire P3 is wound around the core becoming a 60 volt rms wire P4. The 60 volt rms wire P4 is connected in series to a 60 volt rms wire P5. The 60 volt rms wire P5 is wound around the core becoming a 30 volt rms wire P6. The 30 volt rms wire P6 is connected in series to a 30 volt rms wire P7. The 30 volt rms wire P7 is wound around the core becoming a 0 volt rms wire P8 which is the center tap 56 and connected to AC ground. The 0 volt rms wire P8 is connected in series to a 0 volt rms wire P9. The 0 volt rms wire P9 is wound around the core becoming a negative 30 volt rms wire P10. The negative 30 volt rms wire P10 is connected in series to a negative 30 volt rms wire P11. The negative 30 volt rms wire P11 is wound around the core becoming a negative 60 volt rms wire P12. The negative 60 volt rms wire P12 is connected in series to a negative 60 volt rms wire P13. The negative 60 volt rms wire P13 is wound around the core becoming a negative 90 volt rms wire P14. The negative 90 volt rms wire P14 is connected in series to a negative 90 volt rms wire P15. The negative 90 volt rms wire P15 is wound around the core becoming a negative 120 volt rms wire P16.

It is also preferred that the two groups of secondary wires be wound adjacent to the two groups of primary wires to increase coupling between the windings. Having the primary and secondary wires wound side by side in the multifilar ribbon 32, results in tight coupling between the primary windings and the secondary windings. The secondary wires at the beginning end 50 of the multifilar ribbon 32 are connected in parallel. A first secondary wire at the beginning end 50 of the multifilar ribbon 32 is 58, a second secondary wire is 60, a third secondary wire is 62, a fourth secondary wire is 64, a fifth secondary wire is 66, a sixth secondary wire is 68, a seventh secondary wire is 70, and an eighth secondary wire is 72. The first group of secondary wires consists of wires 58, 60, 70 and 72 located on the outside of multifilar ribbon 32. The second group of secondary wires consist of wires 62, 64, 66 and 68.

The secondary wires at the trailing end 52 of the multifilar ribbon 32 are connected in parallel across the bottom row in FIG. 5. A first secondary wire 74 is connected in parallel with a second secondary wire 76, a third secondary wire 78, a fourth secondary wire 80, a fifth secondary wire 82, a sixth secondary wire 84, and seventh wire 86, and an eighth secondary wire 88. The first group of secondary wires includes wires 74, 76, 86 and 88. The second group of secondary wires consists of wires 78, 80, 82 and 84.

The two additional wires added to the multifilar ribbon 32 are labeled XP1 and XP4 at the beginning end 50 of the multifilar ribbon 32, and XP2 and XP3 at the trailing end 52 of the multifilar ribbon 32. The first additional wire XP1 at the beginning end 50 of the multifilar ribbon is located between primary wire P5 and secondary wire 70. The first additional wire XP1 is added in parallel with primary wire P9. The second additional wire XP4 at the beginning end 50 of the multifilar ribbon is located between primary wire P11 and secondary wire 60. The second additional wire XP4 is added in parallel with primary wire P7. The first additional wire XP2 at the trailing end 52 of the multifilar ribbon is located between primary wire P6 and secondary wire 86. The first additional wire XP2 is added in parallel with the primary wire P10. The second additional wire XP3 at the trailing end 52 of the multifilar ribbon is located between primary wire P12 and secondary wire 76. The second additional wire XP3 is added in parallel with primary wire P8. The first half primary winding AB now becomes AB', and the second half primary winding CD now becomes C'D.

By adding these additional two wires in parallel with each half primary winding the potential difference between each half primary winding and the secondary winding is now equal. The two additional wires cause the signal imbalance to be distributed between both half primary windings since they expose the effective capacitance of one half primary winding to that of the other half primary winding.

In the present invention as shown in FIG. 5, there is a 0 volt potential difference between primary wire P7 and secondary wire 68 and between primary wire P8 and secondary wire 84 (point A), and a 30 volt potential difference between additional wire XP1 and secondary wire 70 and between additional wire XP2 and secondary wire 86 (point B') for the first half primary winding AB'. There is a 0 volt potential difference between additional wire XP4 and secondary wire 60 and between additional wire XP3 and secondary wire 76 (point C'), and a 30 volt potential difference between primary wire P9 ad secondary wire 62 and between primary wire P10 and secondary wire 78 (point D) for the second half primary winding C'D. Each half primary winding has the same potential difference between it and the secondary winding equalizing the effective capacitance, and eliminating the signal imbalance at high frequencies.

FIG. 6 shows a wiring diagram of the primary and secondary wires in the multifilar ribbon as depicted in FIG. 5 of the present invention. The beginning end 50 of the multifilar ribbon 32 is shown on the left hand side of FIG. 6. The trailing end 52 of the multifilar ribbon 32 is shown on the right hand side of FIG. 6. The primary wires at the beginning end 50 of the multifilar ribbon are cross connected to the primary wires at the trailing end 52 of the multifilar ribbon in series re-entry at connection 54.

A positive 120 volt rms primary wire P1 is wound around a magnetic core (not shown) becoming a 90 volt rms wire P2. The 90 volt rms wire P2 is connected in series to a 90 volt rms wire P3 at connection 54. The 90 volt rms wire P3 is wound around the core becoming a 60 volt rms wire P4. The 60 volt rms wire P4 is connected in series to a 60 volt rms wire P5 at connection 54. The 60 volt rms wire P5 is wound around the core becoming a 30 volt rms wire P6. The 30 volt rms wire P6 is connected in series to a 30 volt rms wire P7 at connection 54. The 30 volt rms wire P7 is wound around the core becoming a 0 volt rms wire P8. The 0 volt rms wire P8 is connected in series to a 0 volt rms wire P9 at connection 54. The 0 volt rms wire P9 is wound around a core becoming a negative 30 volt rms wire P10. The negative 30 volt rms wire P10 is connected in series to a negative 30 volt rms wire P11 at connection 54. The negative 30 volt rms wire P11 is wound around the core becoming a negative 60 volt rms wire P12. The negative 60 volt rms wire P12 is connected in series to a negative 60 volt rms wire P13 at connection 54. The negative 60 volt rms wire P13 is wound around the core becoming a negative 90 volt rms wire P14. The negative 90 volt rms wire P14 is connected in series to a negative 90 volt rms wire P15 at connection 54. The negative 90 volt rms wire P15 is wound around the core becoming a negative 120 rms wire P16.

The secondary wires 58, 60, 62, 64, 66, 68, 70 and 72 at the beginning end 50 of the multifilar ribbon are all connected in parallel with 30 volts rms across the secondary winding. The secondary wires 74, 76, 78, 80, 82, 84, 86 and 88 are all connected in parallel to AC ground.

The two additional wires added to the multifilar ribbon 32 are labeled XP1 and XP4 at the beginning end 50 of the multifilar ribbon 32, and XP2 and XP3 at the trailing end 52 of the multifilar ribbon 32. The additional wire XP1 at the beginning end 50 of the multifilar ribbon is located between primary wire P5 and secondary wire 70. The additional wire XP1 is added in parallel with primary wire P9 at connector 54. The other additional wire XP4 at the beginning end 50 of the multifilar ribbon is located between primary wire P11 and secondary wire 60. The additional wire XP4 is added in parallel with primary wire P7 at connection 54. The additional wire XP2 at the trailing end 52 of the multifilar ribbon is located between primary wire P6 and secondary wire 86. The additional wire XP2 is added in parallel with the primary wire P10 at connection 54. The other additional wire XP3 at the trailing end 52 of the multifilar ribbon is located between primary wire P12 and secondary wire 76. The additional wire XP3 is added in parallel with primary wire P8 at connection 54. The connection of the two additional wires in parallel with the primary wires is made by simply tying the wires together at connection points 90, 92 and 94 as shown in FIG. 6.

While the invention has been described with reference to a preferred embodiment, those skilled in the art will appreciate that certain substitutions, alterations and omissions may be made without departing from the spirit of the invention. For instance, the winding concept as described above for a transformer having a turns ratio of 8:1 can also be applied to transformers having other turn ratios. Accordingly, the foregoing description is meant to be exemplary only, and should not be deemed limitative on the scope of the invention set forth in the following claims.

I claim:

1. An improved wideband audio output transformer having a common magnetic core with a plurality of continuous magnet wires forming a multifilar ribbon capable of carrying audio signals ranging from an established highest potential to a lowest potential, said ribbon wound in successive insulated winding layers around said magnetic core to form first and second half primary windings; a corresponding secondary winding formed therewith such that a first winding of each said half primary provides a path for an audio signal with the highest potential; said secondary formed substantially adjacent to those respective windings of each said half primary that provides a path for the lowest and second lowest magnitude potential audio signals carried by said respective primary; wherein the wires of each said primary are connected in series re-entry such that after a first winding of each said primary, each successive winding alternates away therefrom; the secondary being arranged into two equally divided groups of magnet wires connected in parallel, with one said divided secondary group disposed between said half primaries, and the other said divided secondary group being divided into two equal first and second secondary sub-groups of magnet wires, with the first said secondary sub group being wound on the outside of one said half primary and the second said secondary sub group being wound on the outside of the other said half primary; an improvement to reduce audio signal imbalance in said primaries, the improvement comprising:

first and second additional magnet wires connected in parallel with each said half primary, each said additional magnet wire being wound co-laterally within said multifilar ribbon, wherein the first additional magnet wire is connected in parallel with the magnet wire carrying the lowest magnitude potential audio signal of the second half primary, the first additional magnet wire being wound between the magnet wire carrying the second lowest magnitude potential audio signal of the first half primary and one said secondary sub-group of magnet wires; and the second additional magnet wire being connected in parallel with the lowest magnitude potential wire of the first half primary, the second additional magnet wire being wound between the magnet wire carrying the second lowest magnitude potential audio signal of the second half primary and the other secondary sub group of magnet wires.

* * * * *